US006499145B1

(12) United States Patent
Kates

(10) Patent No.: US 6,499,145 B1
(45) Date of Patent: Dec. 31, 2002

(54) GLOW HAT APPARATUS AND METHOD

(75) Inventor: Lori A. Kates, Westchester, OH (US)

(73) Assignee: Ebsco Industries, Inc., Birmingham, AL (US)

( * ) Notice: Subject to any disclaimer, the term of this patent is extended or adjusted under 35 U.S.C. 154(b) by 0 days.

(21) Appl. No.: 09/912,105

(22) Filed: Jul. 24, 2001

(51) Int. Cl.[7] ..... A42B 1/00
(52) U.S. Cl. ..... 2/195.1; 2/10; 362/107
(58) Field of Search ..... 2/200.1, 195.1, 2/202, 209.12, 410, 411, 10, 175.5; 362/103, 106, 107

(56) References Cited

U.S. PATENT DOCUMENTS 4,211,813 A * 7/1980 Gravisse et al. ..... 428/263
5,111,366 A * 5/1992 Rife et al. ..... 362/31
5,177,812 A * 1/1993 DeMars ..... 2/199
5,323,492 A * 6/1994 DeMars ..... 2/209.13
5,570,946 A * 11/1996 Chien ..... 362/84
5,904,017 A * 5/1999 Glatz et al. ..... 52/287.1

* cited by examiner

*Primary Examiner*—John J. Calvert
*Assistant Examiner*—Tejash Patel
(74) *Attorney, Agent, or Firm*—Waddey & Patterson; Lucian Wayne Beavers

(57) ABSTRACT

A hat for enhancing visual acquisition of a wearer, comprising a bowl portion for fitting the head of the wearer; a brim portion attached to the bowl portion and extending from the bowl portion; and a first rechargeable glowing portion affixed to at least one of the bowl portion and the brim portion for emitting light energy. More than one rechargeable glowing portions may be added to the hat in various areas as desired. The invention could be alternatively described as a method of enhancing the visual acquisition of a hatted person, comprising the steps of: (a)attaching a rechargeable glowing material to a hat; (b)charging the rechargeable glowing material by placing the hat near a light source; (c)removing the hat from the light source; and (d)wearing the hat away from the light source, so that the rechargeable glowing material gives off light.

20 Claims, 5 Drawing Sheets

GLOW HAT APPARATUS AND METHOD

A portion of the disclosure of this patent document contains material which is subject to copyright protection. The copyright owner has no objection to the facsimile reproduction by anyone of the patent document or patent disclosure, as it appears in the Patent and Trademark Office, patent file or records, but otherwise reserves all copyright rights whatsoever.

BACKGROUND OF THE INVENTION

The present invention relates generally to a hat that is worn by a wearer, as well as a method of making the hat. More particularly, this invention pertains to a hat having one or more glowing (also called "photoluminescent" or "glow in the dark") portions that are sewn or otherwise attached to the hat for increasing the visibility of wearer, especially in low-light conditions. The hat as described herein may also be worn as a novelty item to increase the enjoyment of the wearer.

Hats have traditionally been worn for various purposes. Some hats are worn for protection from the sun or other elements, while others are worn purely for enjoyment. Still other people wear a hat while jogging or exercising. Whatever the reason, hats can be found being worn with great frequency in public.

Particularly in the case where one is jogging at night, the risk of not being seen by motorists and others exists. In such cases, the probability of an accident is increased. What is needed, then, is a hat that will increase the visibility of a wearer in low-lighting conditions. Additionally, what is needed is a hat that will raise the level of enjoyment of the wearer while wearing the hat.

SUMMARY OF THE INVENTION

The invention is a hat that increases the visibility of a wearer by incorporating one or more strips of photoluminescent material into the hat. Enhancement of the hat as described herein will also increase the enjoyment of the wearer as a novelty.

The hat of the invention is similar to most baseball caps in that it has a bowl that fits over the skull of the wearer and a bill that extends from the bowl. The novel and distinguishing feature of the hat of the invention is that one or more areas of the hat incorporate a photoluminescent material that has the capability of absorbing energy from a light source, then giving off that energy as a glowing light over a period of time. This giving-off of light is most striking and notable when the hat is worn in darkened conditions. The photoluminescent material could be attached to different portions of the hat, as desired, and more than one area could be so adorned.

The giving off of light in darkened conditions aids in visual acquisition of the wearer, which could increase the safety of the wearer by enabling automobile drivers and others to see and avoid the wearer. Also, wearing the hat of the invention would increase the enjoyment of the wearer as a novelty item in that such a hat would be a conversation piece.

The invention also is described herein as a method of enhancing the visual acquisition of a hatted person by attaching a rechargeable glowing material to a hat, charging the rechargeable glowing material by subjecting the hat to a light source, removing the hat from the light source, and wearing the hat away from the light source, so that the rechargeable glowing portion gives off light.

Accordingly, it is an object of the present invention to provide a hat that increases the visibility of the wearer.

It is a further object of the invention to provide a hat having photoluminescent material attached for increasing the wearing enjoyment of the wearer.

In addition to the foregoing, further objects, features, and advantages of the present invention should become more readily apparent to those skilled in the art upon a reading of the following detailed description in conjunction with the drawings, wherein there are shown and described illustrated embodiments of the invention.

DESCRIPTION OF THE PREFERRED EMBODIMENT

Figure 1:
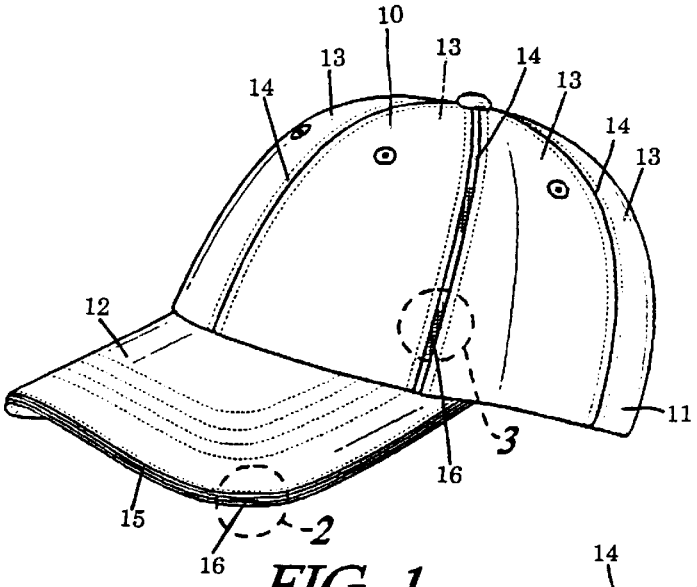
FIG. 1 is a perspective view of a first embodiment of the hat of the invention.

Referring to FIG. 1, a first embodiment of the hat 10 of the invention is 15 shown, with a bowl portion 11 and a bill portion 12. Bowl portion 11 has six triangular panels 13 of equal dimension, each triangular panel joined to two other triangular panels at one of the seams 14. Seams 14 are preferably junctions where two triangular panels 13 are sewn together.

Further referring to FIG. 1, bill 12 has an edge 15 which is formed by the outer perimeter of bill 12. The core of bill 12 is a semi-rigid core as is found in most cap-type hats, and the core is covered by the fabric of the hat. Specifically, the core has fabric covering both the top surface and the bottom surface of the core. Traditionally, the core would be completely covered by fabric. However, unlike prior art hats, edge 15 is covered with a photoluminescent material 16, which is represented as a checked area in FIG. 1 and through all figures herein, before the fabric covering is applied to the core, leaving photoluminescent material 16 exposed throughout edge 15.

Figure 3:
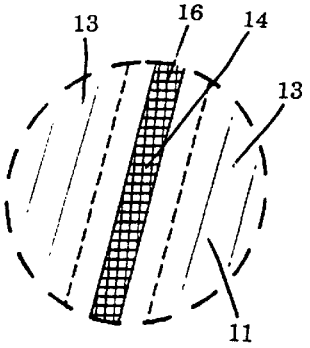
FIG. 3 is a magnified view of a portion of the bowl of the hat of FIG. 1, illustrating a strip of photoluminescent material attached thereto.
Figure 2:
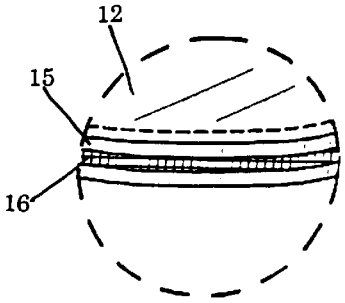
FIG. 2 is a magnified view of a portion of the bill of the hat of FIG. 1, illustrating a strip of photoluminescent material attached thereto.

Referring to FIG. 2, edge 15 of bill 12 is shown in magnified view, with photoluminescent material 16 fixed to and exposed on edge 15. Photoluminescent material 16 may be attached to edge 15 by sewing or adhesion. Once attached to edge 15, photoluminescent material 16 is exposed; no fabric is applied to cover photoluminescent material 16. Referring to FIG. 3, a section of bowl portion 11 is shown in magnified view, with triangular sections 13 being joined at a seam 14, and with photoluminescent material 16 fixed in and exposed on seam 14. Again, photoluminescent material 16 may be fixed in seam 14 by sewing or adhesion, and no fabric covers photoluminescent material 16.

Photoluminescent material 16 is made of a rechargeable glowing material that absorbs energy from a light source and emits light after a period of charging. Photoluminescent material 16 is a "glow-in-the-dark" photoluminescent-pigmented material of a dimensionally stable, multi-layer construction. Photoluminescent material 16 is flexible, durable, and safe to use on hat 10.

Further referring to FIG. 2, photoluminescent material 16 is rechargeable, meaning that the "glow-in-the-dark" characteristic of photoluminescent material 16 is activated by subjecting the material to a light source, then removing the material from the light source, such that the material glows in the dark. When exposed to a light source such as a fluorescent light for a period of time such as three (3) minutes, photoluminescent material 16 gives off a light yellowish-green glow for up to eight (8) hours. The longer photoluminescent material 16 is exposed to the light source, the longer the glow will be effected. Photoluminescent material 16 also has a thickness of about 0.4 mm, a weight of 450 grams per yard, and has sufficient flexibility to be sewn into apparel having flat surfaces or simple curves such as hat 10.

Photoluminescent material 16 may be recharged as desired by subjecting the fabric to an adequate light source. A cool white fluorescent light such as a typical office light bulb is recommended in order to illuminate the material's surface to 200–300 lux. While many environmental characteristics such as observation conditions, ambient light, and the observer affect the afterglow of photoluminescent material 16, the material's afterglow invariably degrades over time. Maximum afterglow is about 120 millicandela per square meter; afterglow may degrade to below 1 millicandela per square meter. In an alternative embodiment, Scotchcal™ Photoluminescent Film 5900 ("5900 film"), an adhesive-backed film manufactured by 3M™, may be used in place of photoluminescent material 16 with similar results.

Figure 4:
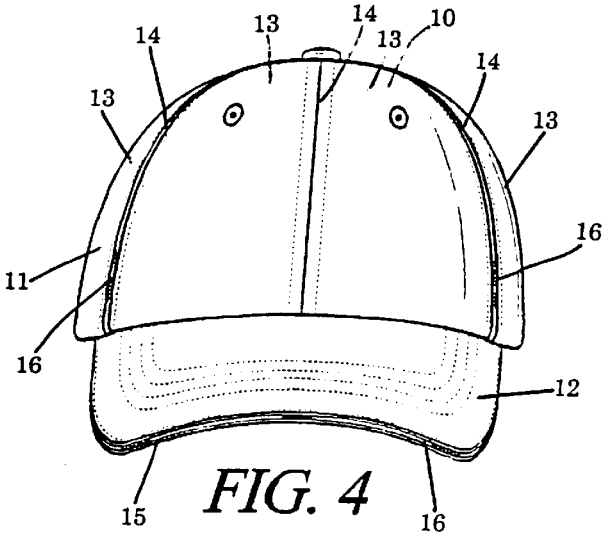
FIG. 4 is a front elevation of the hat of FIG. 1.

Referring to FIG. 4, the front elevation of hat 10 shows the bowl portion 11 and bill portion 12, with bowl portion 11 having triangular panels 13 attached at their sides, forming seams 14. Photoluminescent material 16 is attached to the outer two seams 14 in the manner previously described. Bill portion 12 has an outer edge 15, to which is attached photoluminescent material 16 in the previously described manner.

Figure 5:
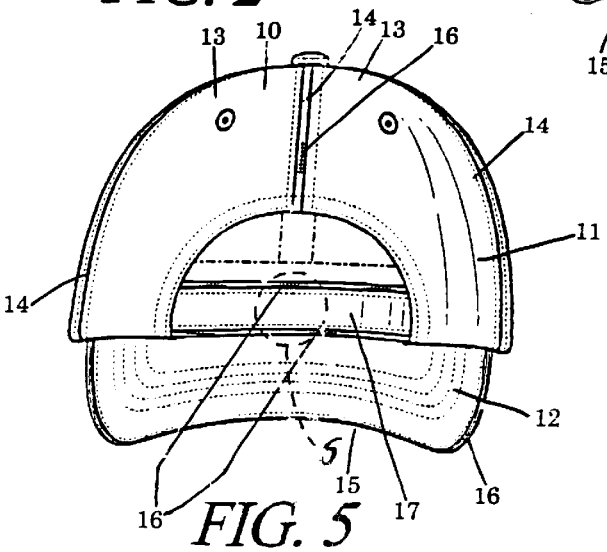
FIG. 5 is a rear elevation of the hat of FIG. 1.

Referring to FIG. 5, the rear elevation of hat 10 is shown, having bowl portion 11 and bill portion 12. Triangular panels 13 are joined at their sides at seams 14, and the center seam 14 has a strip of photoluminescent material 16 affixed thereto in the same manner as previously described. Furthermore, bill portion 12 has an edge 15 having photoluminescent material 16 affixed thereto. An adjustable tab 17 is shown at the rear of hat 10 in FIG. 5 and a portion of adjustable tab 17 is shown in magnified view in FIG. 6.

Figure 6:
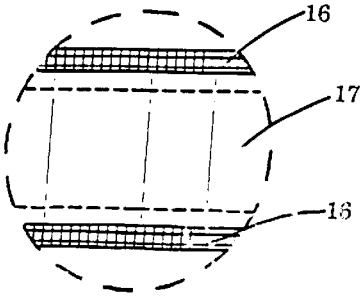
FIG. 6 is a magnified view of a portion of the hat of FIG. 5, illustrating at least one strip of photoluminescent material attached thereto.

Further referring to FIGS. 5 and 6, adjustable tab 17 is a strip of fabric that employs plastic interlocking tabs, metal buckles, Velcro hook and loop fastener, or some other conventional means of adjustably fixing adjustable tab 17. At least one strip of photoluminescent material 16 is attached to adjustable tab 17. Photoluminescent material 16 may be applied across the entire inner surface of adjustable tab 17 by sewing, adhesion, or other normal attaching method. Alternatively, photoluminescent material 16 may be attached within or otherwise sandwiched between multiple layers of adjustable tab 17. In a third possible configuration, two strips of photoluminescent material 16 would be sewn or otherwise attached to the upper and lower edges of adjustable tab 17.

Figure 7:
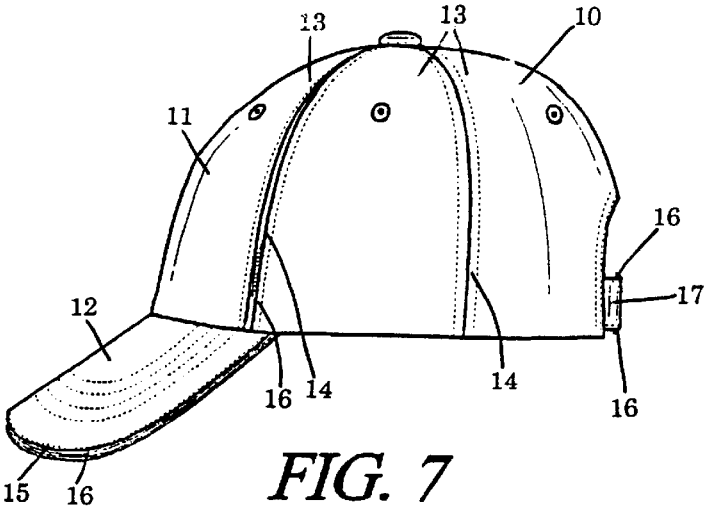
FIG. 7 is a side elevation of the hat of FIG. 1.

Referring to FIG. 7, a side elevation of hat 10 shows the bowl portion 11 and bill portion 12, with bowl portion 11 having triangular panels 13 attached at their sides forming seams 14. The forward seam 14 has a strip of photoluminescent material 16 attached thereto. Bill 12 has an outer edge 15, to which is attached photoluminescent material 16 in the manner previously described relating to FIGS. 1 and 2. Further referring to FIG. 7, adjustable tab 17 is shown having at least one strip of photoluminescent material 16 attached thereto.

Figure 8:
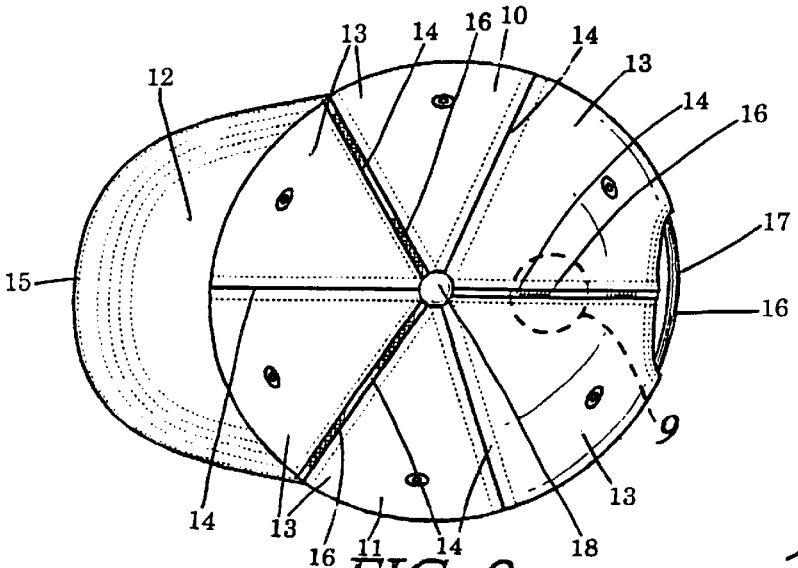
FIG. 8 is a plan view the hat of FIG. 1.

Referring to FIG. 8, a plan view of hat 10 is shown, having bowl portion 11 and bill portion 12. Bowl portion 11 has six triangular panels 13, each triangular panel 13 being joined at two of its sides to two other triangular panels 13, each junction forming a seam 14. Six seams 14 intersect each other at a crown point 18, and each seam forms an angle of approximately 60° with respect to each adjacent seam 14. Beginning at the rear-extending seam 14 and traversing the circle formed by bowl portion 11 in either direction, each alternating seam 14 has a strip of photoluminescent material 16 attached thereto.

Figure 9:
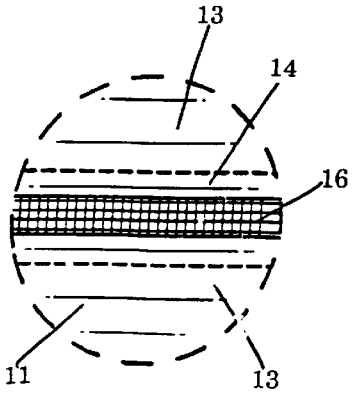
FIG. 9 is a magnified view of a portion of the hat of FIG. 9, illustrating a strip of photoluminescent material attached thereto.

Further referring to FIG. 8, bill portion 12 has an outer edge 15 to which is fixed a strip of photoluminescent material 16. An adjustable tab 17 further has at least one strip of photoluminescent material 16 affixed to adjustable tab 17, such that the photoluminescent material extends from both the upper and lower edges of adjustable tab 17. Referring to FIG. 9, a magnified area of one of the seams in bowl portion 11 is shown, having the seam 14 between two triangular panels 13 with a strip of photoluminescent material 16 attached thereto in the manner previously described relating to FIGS. 1 and 3.

Figure 10:
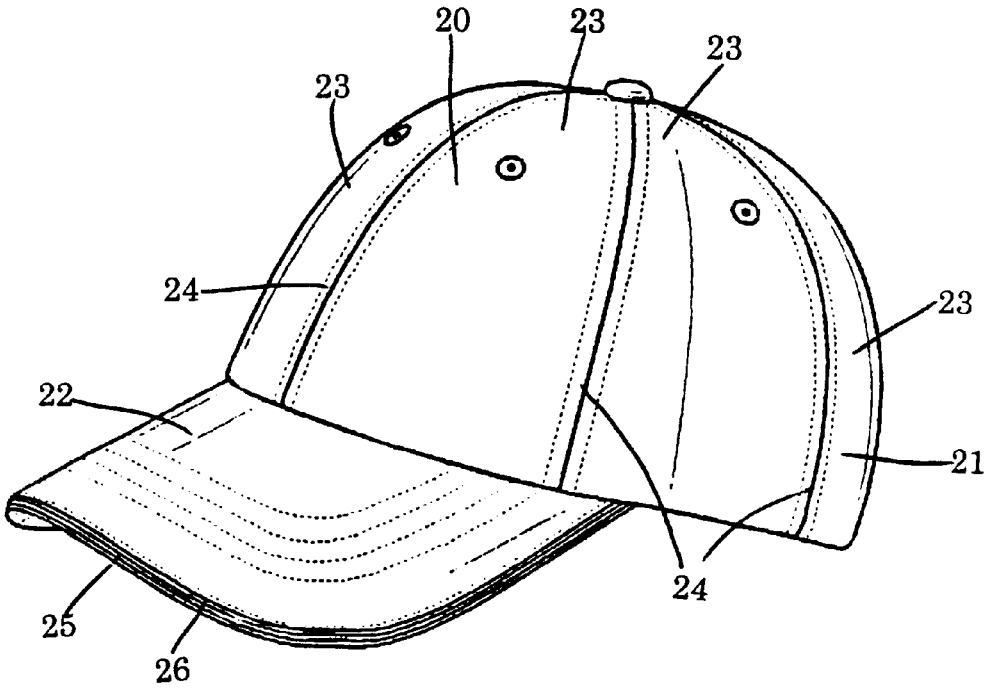
FIG. 10 is a perspective view of a second embodiment of the hat of the invention.

Referring to FIG. 10, a second embodiment of the hat 20 of the invention is shown, with a bowl portion 21 and a bill portion 22. Bowl portion 21 has six triangular panels 23 of approximately equal dimension, each triangular panel joined to two other triangular panels at one of the seams 24. Seams 24 are preferably junctions where two triangular panels 23 are sewn together. Bill 22 has an edge 25 which is formed by the outer perimeter of bill 22. The core of bill 22 is a semi-rigid core as found in most cap-type hats, and the core is covered by the fabric of the hat. Specifically, the core has fabric covering the top surface of the core and fabric covering the bottom surface of the core. Traditionally, the core would be completely covered by fabric.

Further referring to FIG. 10, edge 25 is covered with a photoluminescent material 26 before the fabric covering is applied to the core, leaving photoluminescent material 26 exposed throughout edge 25. Photoluminescent material 26 may be attached to edge 25 of hat 20 by known affixation methods such as sewing or adhesion. Once attached to edge 25, photoluminescent material 26 is exposed to light, charging the photoluminescent material so that it glows in the dark; no fabric is applied to cover photoluminescent material 26.

Figure 11:
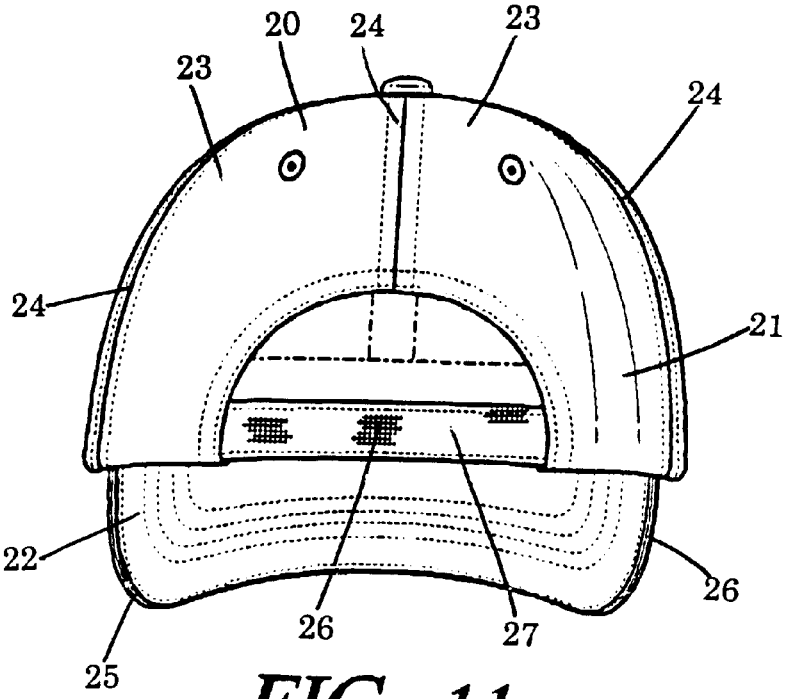
FIG. 11 is a rear elevation of the hat of FIG. 10.

Referring to FIG. 11, the rear view of hat 20 is shown, namely bowl portion 21 and bill portion 22. Triangular panels 23 are joined at their sides at seams 24. An adjustable tab 27 is shown at the rear of hat 20. Adjustable tab 27 is a strip of fabric or plastic that employs plastic interlocking tabs, metal buckles, Velcro hook and loop fastener, or some other conventional means of adjustably fixing adjustable tab 27. The entire outer surface of adjustable tab 27 is covered with photoluminescent material via sewing, adhesion, or some other conventional attachment means. Further referring to FIG. 11, bill portion 22 has an outer edge 25 to which is affixed a strip of photoluminescent material 26, the strip of photoluminescent material 26 being coextensive with and exposed on edge 25.

Figure 12:
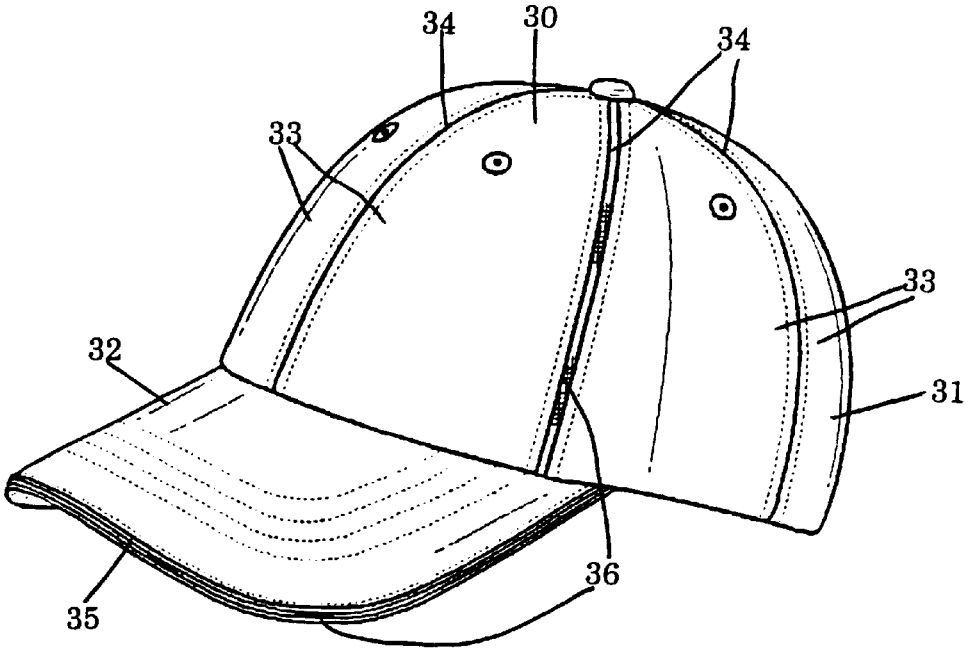
FIG. 12 is a perspective view of a third embodiment of the hat of the invention.

Referring to FIG. 12, a third embodiment of the hat 30 of the invention is shown, with a bowl portion 31 and a bill portion 32. Bowl portion 31 has triangular panels 33 of equal dimension, each triangular panel 33 joined to two other triangular panels at seams 34. Seams 34 are junctions where two triangular panels 33 are preferably sewn together. Bill portion 32 has an edge 35 which is formed by the outer perimeter of bill 32. The core of bill portion 32 is a semi-rigid core as found in most cap-type hats, and the core is covered by the fabric of the hat. Specifically, the core has fabric that covers both the top and bottom surfaces of the core, and normally the core would be completely covered by fabric.

Further referring to FIG. 12 one of the forward seams 34 has a strip of photoluminescent material 36 attached to and coextensive with seam 34. Additionally, edge 35 is preferably covered with a photoluminescent material 36 before the fabric covering is applied to the core, leaving photoluminescent material 36 exposed throughout edge 35. Photoluminescent material 36 may be attached to edge 35 of hat 3G by sewing or adhesion. Once attached to edge 35, photoluminescent material 36 is exposed to light, which allows photoluminescent material 36 to be charged so that photoluminescent material 36 glows in the dark; no fabric is applied to cover photoluminescent material 36.

Figure 13:
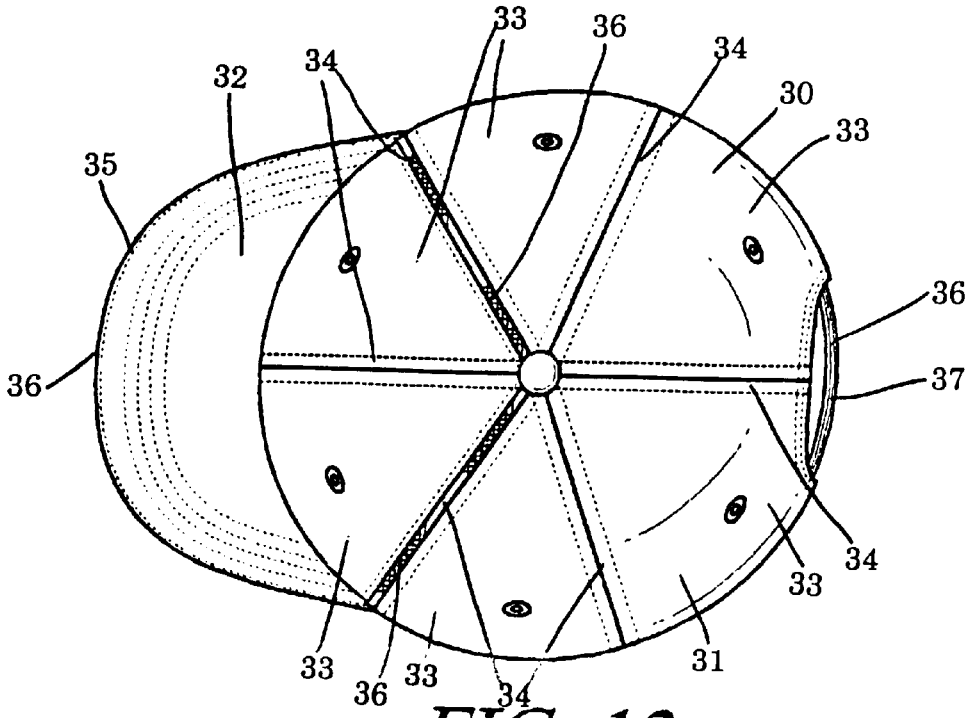
FIG. 13 is a plan view of the hat of FIG. 12.

Referring to FIG. 13, hat 30 is shown in plan view, with bowl portion 31 and brim portion 32. Bowl portion 31 consists largely of triangular portions 33 that intersect and are sewn or attached at their sides at seams 34. Strips of photoluminescent material 36 are attached to and coextensive with two of the front seams 34 of hat 30. Photoluminescent material 36 is preferably sewn into the front two seams 34 of hat 30. Bill portion 32 has an outer edge 35 to which is affixed a strip of photoluminescent material 36. An adjustable tab 37 is incorporated into the rear area of bowl portion 31, and one or more strips of photoluminescent material 36 are affixed to adjustable tab 37, such that the photoluminescent material 36 extends from the upper and lower edges of adjustable tab 37.

Figure 14:
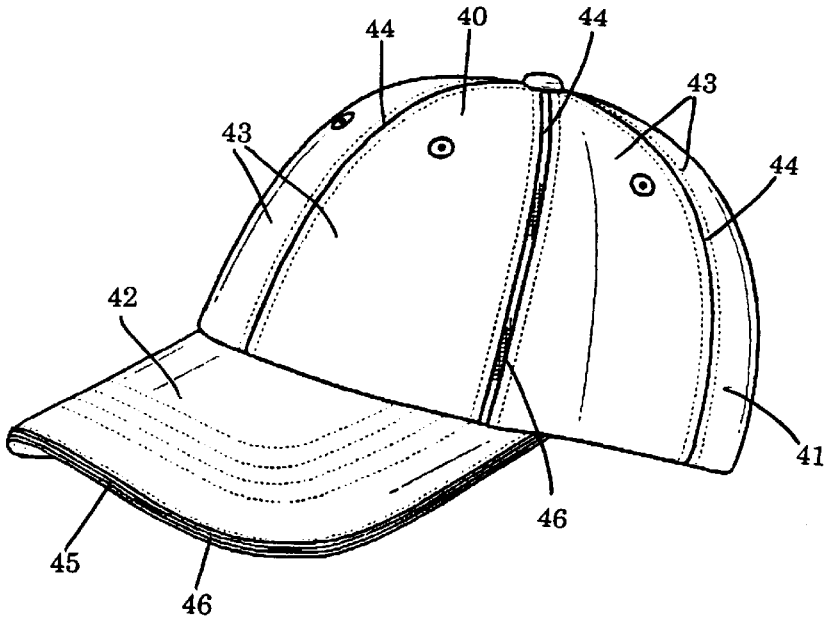
FIG. 14 is a perspective view of a fourth embodiment of the hat of the invention.

Referring to FIG. 14, a fourth embodiment of the hat 40 of the invention is shown, with a bowl portion 41 and a bill portion 42. Bowl portion 41 has six triangular panels 43 of equal dimension, each triangular panel joined to two other triangular panels at one of the seams 44. Seams 44 are preferably junctions where two triangular panels 43 are sewn together. Bill portion 42 has an edge 45 which is formed by the outer perimeter of bill portion 42. The core of bill 42 is a semi-rigid core as found in most cap-type hats, and the core is covered by the fabric of the hat. Specifically, the core has fabric covering the top surface of the core and fabric covering the bottom surface of the core. Traditionally, the core would be completely covered by fabric.

Further referring to FIG. 14, edge 45 is covered with a photoluminescent material 46 before the fabric covering is applied to the core, leaving photoluminescent material 46 exposed throughout edge 45. Photoluminescent material 46 may be attached to edge 45 of hat 40 by sewing or adhesion. Once attached to edge 45, photoluminescent material 46 is exposed to light, charging photoluminescent material 46 so that it glows in the dark; no fabric is applied to cover photoluminescent material 46. A strip of photoluminescent material 46 is also attached to and coextensive with one of the front seams 44.

Figure 15:
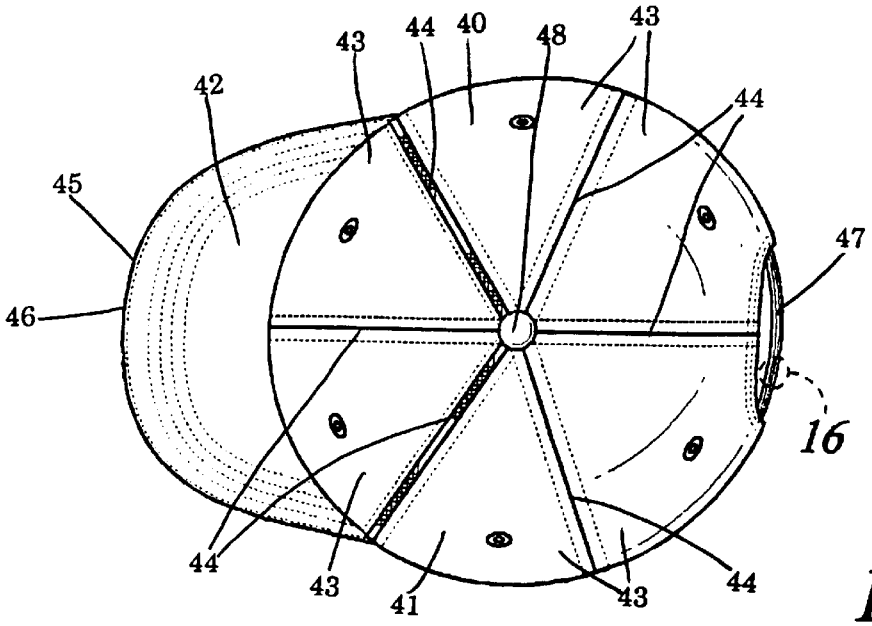
FIG. 15 is a plan view of the hat of FIG. 14.
Figure 16:
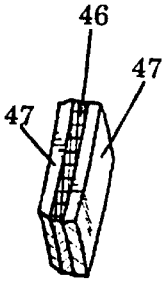
FIG. 16 is a magnified view of a portion of the hat of FIG. 15, illustrating a strip of photoluminescent material attached thereto.

Referring to FIG. 15, the hat of FIG. 14 is shown in plan view, with a bowl portion 41 and a brim portion 42. Bowl portion 41 is made up of six triangular panels 43 of roughly equal proportions, each triangular panel 43 being attached to two other triangular portions at two of its sides, the attaching in turn forming seams 44. Seams 44 intersect each other at a crown point 48 at angles of 60° with respect to each adjacent seam 44. Two of the forward seams 44 have strips of photoluminescent material 46 attached thereto in the manner previously described for other embodiments, such that strips of photoluminescent material 46 intersect each other at a crown point 48 at 120° to each other. Photoluminescent material 46 is preferably sewn into seams 44 of hat 40. Bill portion 42 has an outer edge 45 to which is affixed a strip of photoluminescent material 46, exposed thereon and coextensive with edge 45. Finally an adjustable tab 47 forms part of the rear area of bowl portion 41 in a conventional manner. A strip of photoluminescent material forms part of adjustable tab 47, so that strip of photoluminescent material 46 extends from the upper and lower edges of adjustable tab 47. Referring to FIG. 16, a portion of adjustable tab 47 is shown in magnified view, with photoluminescent material 46 being sandwiched between layers of adjustable tab 47.

The invention may also be described as a method of enhancing the visual acquisition of a hatted person, comprising the steps of: (a)attaching a rechargeable glowing material to a hat; (b)charging the rechargeable glowing material by placing the hat near a light source; (c)removing the hat from the light source; and (d)wearing the hat away from the light source, so that the rechargeable glowing material gives off light.

Thus, although there have been described particular embodiments of the present invention of a new and useful "Glow Hat Apparatus and Method," it is not intended that such references be construed as limitations upon the scope of this invention except as set forth in the following claims.

I claim:

1. A hat for enhancing visual acquisition of a wearer, comprising:

a bowl portion for fitting the head of the wearer, wherein the bowl portion further comprises a plurality of fabric panels sewn together at one or more seams;

a brim portion attached to the bowl portion and extending from the bowl portion;

a first rechargeable glowing portion affixed to at least one of the bowl portion and the brim portion for emitting light energy, the first rechargeable glowing portion being able to absorb energy from a light source to emit light energy; and a second rechargeable glowing portion sewn into at least one seam.

2. The hat of claim 1, further comprising a second glowing portion affixed to one of the bowl portion and the brim portion for emitting light energy.

3. The hat of claim 1, wherein the first rechargeable glowing portion is affixed to at least one of the bowl portion and brim portion by sewing the first rechargeable glowing portion onto the material of the hat.

4. The hat of claim 1, wherein the first rechargeable glowing portion is of a material having an uncharged state and a charged state, the glowing portion emitting light in the charged state.

5. The hat of claim 4, wherein the first rechargeable glowing portion emits light at up to 300 lux when the glowing portion is in the charged state.

6. The hat of claim 4, wherein the first rechargeable glowing portion emits light for up to eight hours in the charged state.

7. The hat of claim 1, wherein the first rechargeable glowing portion is converted from the uncharged state to the charged state by exposing the glowing portion to a light source.

8. The hat of claim 7, wherein the light source is the sun.

9. The hat of claim 7, wherein the light source is a light bulb.

10. The hat of claim 1, wherein the first rechargeable glowing portion glows in the dark.

11. A cap for enhancing the visual acquisition of a wearer, comprising:

a bowl for fitting closely to the head of the wearer;

a bill attached to the bowl, the bill having an outer edge; and a photoluminescent strip attached to the outer edge of the bill.

12. The cap of claim 11, wherein the photoluminescent strip is sewn into the outer edge of the bill.

13. A cap for enhancing the visual acquisition of a wearer, comprising:

a bowl for fitting closely to the head of the wearer, the bowl having a lower edge, the lower edge incorporating a headband for enhancing support of the cap on the head of the wearer, the headband including an adjustable headband tab for adjusting the size of the headband to the head of the wearer;

a bill attached to the bowl; and a photoluminescent strip attached to the adjustable headband tab.

14. The cap of claim 13, wherein the adjustable headband tab further comprises a top edge and a bottom edge, and the photoluminescent strip is attached to at least one of the top edge and the bottom edge.

15. The cap of claim 13, further comprising a second photoluminescent strip, wherein the adjustable headband tab has the first photoluminescent strip attached to the top edge of the adjustable headband tab, and the second photoluminescent strip attached to the bottom edge of the adjustable headband tab.

16. A cap for enhancing the visual acquisition of a wearer, comprising:

a bowl for fitting closely to the head of the wearer, the bowl including:

a plurality of triangular panels, the panels attached to each other to form the bowl;

a plurality of seams, each seam defined by the junction of two of the triangular panels, each seam further being created by sewing a side of one of the triangular panels to a side of an adjacent triangular panel;

a bill attached to the bowl; and a photoluminescent strip attached to the seam between two of the triangular panels.

17. The cap of claim 16, wherein the plurality of seams equals six and only six seams.

18. The cap of claim 16, further comprising a second photoluminescent strip, wherein the first photoluminescent strip is attached to and coextensive with a first one of the plurality of seams, and the second photoluminescent strip is attached to and coextensive with a second one of the plurality of seams.

19. The cap of claim 18, wherein the first photoluminescent strip and the second photoluminescent strip intersect at a crown point, the first photoluminescent strip and the second photoluminescent strip intersecting to form a 120 degree angle.

20. The cap of claim 19, further comprising a third photoluminescent strip, the third photoluminescent strip attached to and coextensive with a third one of the plurality of seams, the third photoluminescent strip ending at the crown point and intersecting the first photoluminescent strip and the second photoluminescent strip to form a 120 degree angle with each of the first photoluminescent strip and the second photoluminescent strip.

* * * * *